US009089028B2

(12) United States Patent
Radermacher et al.

(10) Patent No.: US 9,089,028 B2
(45) Date of Patent: Jul. 21, 2015

(54) LIGHT EMITTING DEVICE AND SYSTEM

(71) Applicant: KONINKLIJKE PHILIPS N.V., Eindhoven (NL)

(72) Inventors: Harald Josef Günther Radermacher, Aachen (DE); Bob Bernardus Anthonius Theunissen, Zaltbommel (NL); Hugo Veenstra, Kleine Brogel (BE); Adrianus Sempel, Waalre (NL)

(73) Assignee: KONINKLIJKE PHILIPS N.V., Eindoven (NL)

( * ) Notice: Subject to any disclaimer, the term of this patent is extended or adjusted under 35 U.S.C. 154(b) by 0 days.

(21) Appl. No.: 14/365,747

(22) PCT Filed: Dec. 12, 2012

(86) PCT No.: PCT/IB2012/057226

§ 371 (c)(1),
(2) Date: Jun. 16, 2014

(87) PCT Pub. No.: WO2013/088361

PCT Pub. Date: Jun. 20, 2013

(65) Prior Publication Data

US 2014/0333225 A1 Nov. 13, 2014

Related U.S. Application Data

(60) Provisional application No. 61/570,976, filed on Dec. 15, 2011.

(51) Int. Cl.
*H05B 37/02* (2006.01)
*H05B 33/08* (2006.01)

(52) U.S. Cl.
CPC ..... *H05B 33/0821* (2013.01); *H05B 33/0827* (2013.01); *H05B 33/0845* (2013.01)

(58) Field of Classification Search
USPC ..... 315/312, 160–165, 191–192, 185 S, 315/294–295, 227 R, 228–229, 234–232
See application file for complete search history.

(56) References Cited

U.S. PATENT DOCUMENTS

| | | | | |
|---|---|---|---|---|
| 2006/0255753 | A1 | 11/2006 | Sawada et al. | |
| 2010/0079086 | A1 * | 4/2010 | Chang | 315/294 |
| 2010/0295472 | A1 | 11/2010 | Wibben et al. | |
| 2011/0210679 | A1 * | 9/2011 | Koepke et al. | 315/192 |

FOREIGN PATENT DOCUMENTS

| | | | |
|---|---|---|---|
| WO | 2008007298 | A2 | 1/2008 |
| WO | 2009019634 | A1 | 2/2009 |
| WO | 2010064183 | A1 | 6/2010 |

* cited by examiner

*Primary Examiner* — Minh D A
(74) *Attorney, Agent, or Firm* — Yuliya Mathis

(57) ABSTRACT

Devices comprise first and second terminals (1,2) connected to first load circuits (21) comprising first light emitting diodes, and third and fourth terminals (3, 4) connected to second load circuits (22) comprising second light emitting diodes, first connections (11) that interconnect the first and third terminals (1, 3), second connections (12) that interconnect the second and fourth terminals (2, 4), at least one of the first and second connections (11, 12) being a power dissipating connection, at least one of the first and second load circuits (21, 22) being adapted to receive first power from a source (31) via the first and second connections (11, 12), and capacitors (41) coupled in parallel to the second load circuits (22) for storing energy received via elements (42) with current-direction-dependencies and for providing second power to at least the second load circuit (22).

14 Claims, 4 Drawing Sheets

LIGHT EMITTING DEVICE AND SYSTEM

CROSS-REFERENCE TO PRIOR APPLICATIONS

This application is the U.S. National Phase application under 35 U.S.C. §371 of International Application No. PCT/IB2012/057226, filed on Dec. 12, 2012, which claims the benefit of [e.g., U.S. Provisional Patent Application No. or European Patent Application No.] 61/570,976, filed on Dec. 15, 2011. These applications are hereby incorporated by reference herein.

FIELD OF THE INVENTION

The invention relates to a light emitting device. The invention further relates to a system comprising a light emitting device.

Examples of such a light emitting device are lamps and parts thereof. Examples of such a system are lamps including sources.

BACKGROUND OF THE INVENTION

WO2008/007298A2 discloses a device for applying power to a load selected from a plurality of loads. For this purpose, the device comprises a switch per load and a control section for controlling the switches.

SUMMARY OF THE INVENTION

It is an object of the invention to provide an improved light emitting device. It is a further object of the invention to provide an improved system.

According to a first aspect, a light emitting device is provided comprising first and second terminals connected to a first load circuit comprising at least one first light emitting diode, third and fourth terminals connected to a second load circuit comprising at least one second light emitting diode, a first connection adapted to interconnect the first and third terminals, and a second connection adapted to interconnect the second and fourth terminals, at least one of the first and second connections being a power dissipating connection, at least one of the first and second load circuits being adapted to receive first power from a source via the first and second connections, and a capacitor coupled in parallel to the second load circuit and adapted to store energy received via an element with a current-direction-dependency and to provide second power to at least the second load circuit.

The light emitting device comprises first and second terminals connected to a first load circuit comprising at least one first light emitting diode, and comprises third and fourth terminals connected to a second load circuit comprising at least one second light emitting diode. To prevent that a source is required for each load circuit, the first and third terminals are connected to each other via a first connection, and the second and fourth terminals are connected to each other via a second connection. As a result, at least one of the first and second load circuits will receive first power from a source via these first and second connections. Usually, at least one of the first and second connections will be a power dissipating connection, owing to the fact that an ideal connection that is free from power loss cannot be realized in the real world. As a result, the combination of the first and second load circuits will show a non-uniform power distribution, unless additional measures are taken.

To be able to apply power in a more advanced way, without requiring a switch per load and a control section for controlling the switches, the light emitting device is provided with a capacitor coupled in parallel to the second load circuit and adapted to store energy received via an element with a current-direction-dependency and to provide second power to at least the second load circuit. As a result, both first and second load circuits are fed via the source, without the capacitor being in between, and at least the second load circuit is also fed via/by the capacitor, and power can be applied in a more advanced way, by addressing/charging the capacitor via the element with the current-direction-dependency.

Each load circuit comprises one or more light emitting diodes of any kind and in any combination. To the left of the first load circuit, between the first and the second load circuit, and to the right of the second load circuit, further load circuits may be present.

An embodiment of the light emitting device is defined by the capacitor being coupled in parallel to the second load circuit via a further element with a current-direction-dependency that is adapted to prevent that the capacitor is charged via a current path through the third and fourth terminals. This way, the capacitor is only charged via the element with the current-direction-dependency and is not charged via a current path through the third and fourth terminals. Via the further element with the current-direction-dependency, however, the capacitor is able to supply the second power.

An embodiment of the light emitting device is defined by at least one of the first and second connections being adapted to respectively connect the first and third terminals and the second and fourth terminals via a further element with a current-direction-dependency that is adapted to prevent that the capacitor provides a part of the second power to the first load circuit. This way, the capacitor can only supply the second power to the second load circuit, and the second power is supplied more accurately.

An embodiment of the light emitting device is defined by the source being adapted to supply the first power as well as the energy in the form of a direct-current voltage signal or a pulsed voltage signal or a combination thereof. This way, the source has a double function, which is efficient. The direct-current voltage signal or DC voltage signal may have an adjustable amplitude to control the charging of the capacitor. The pulsed voltage signal may have an adjustable amplitude and/or an adjustable duty cycle to control the charging of the capacitor. And the pulsed voltage signal may be added to the DC voltage signal etc.

An embodiment of the light emitting device is defined by the first load circuit comprising a further capacitor adapted to filter the pulsed voltage signal. This way, the pulsed voltage signal is filtered inside the first load circuit. The further capacitor for example reduces a peak current that may arise in response to the pulsed voltage signal and/or for example reduces unwanted operation of the first load circuit (such as the lighting or flickering of the first light emitting diode) in response to the pulsed voltage signal. In the case that the first load circuit comprises a string of first serial light emitting diodes, the further capacitor may be connected in parallel to the string.

An embodiment of the light emitting device is defined by the first and second terminals being adapted to be coupled to the source, the second load circuit being adapted to receive the first power from the source via the first and second connections. Here, the first load circuit is considered to be located closer to the source than the second load circuit.

An embodiment of the light emitting device is defined by further comprising fifth and sixth terminals connected to a third load circuit comprising at least one third light emitting diode, the third load circuit being adapted to receive third power from a further source.

Here the light emitting device is considered to further comprise the third load circuit that receives the third power from the further source, that may be the same source as used for feeding the first and second load circuits or that may be a different source.

An embodiment of the light emitting device is defined by further comprising seventh and eighth terminals connected to a fourth load circuit comprising at least one fourth light emitting diode, a third connection adapted to interconnect the fifth and seventh terminals, and a fourth connection adapted to interconnect the sixth and eighth terminals, at least one of the third and fourth connections being a power dissipating connection, and the fourth load circuit being adapted to receive fourth power from the further source via the third and fourth connections.

Here the light emitting device is considered to further comprise the fourth load circuit that receives the fourth power from the further source. Again, usually, at least one of the third and fourth connections will be a power dissipating connection.

An embodiment of the light emitting device is defined by the third and seventh terminals being adapted to be connected to each other via one or more further connections, and the fourth and eighth terminals being adapted to be connected to each other via one or more further connections. Again, usually, at least one of the one or more further connections will be a power dissipating connection. As a result, in the case that the source and the further source are the same source, the respective first, second, fourth and third load circuits are fed from left to right as well as from right to left, and via the capacitor additional power can be introduced somewhere in the center. In the case that the source and the further source are different sources, the respective first, second, fourth and third load circuits are fed from left to right via the source and from right to left via the further source, and via the capacitor and the element having the current-direction-dependency additional power can be introduced somewhere in the center. Further capacitors and further elements having current-direction-dependencies are not to be excluded to guide additional power to more locations.

An embodiment of the light emitting device is defined by the first load circuit being adapted to receive the first power from the source via the first and second connections. Here, the second load circuit is considered to be located closer to the source than the first load circuit.

An embodiment of the light emitting device is defined by both first and second connections being power dissipating connections, the first connection comprising a conductor with a resistance larger than zero, and the second connection comprising a resistor. This way, via the resistor that intentionally introduces a loss of power, the power distribution can be adapted by selecting a value of the resistor.

An embodiment of the light emitting device is defined by the respective first and second load circuits comprising respective first and second resistors connected serially to the respective first and second light emitting diodes. This way, the power distribution can be adapted by selecting values of the first and second resistors.

An embodiment of the light emitting device is defined by the first and second load circuits having different operating voltages. This way, by selecting proper operating voltages of the first and second load circuits and possibly of the element with the current-direction-dependency and possibly of the third and fourth load circuits, and by selecting a proper value of each resistor, and by selecting a proper value or proper values of the DC voltage signal or the pulsed voltage signal or the combination thereof, a power distribution can be realized that results in a uniform light intensity distribution. By adapting the value or values of the DC voltage signal or the pulsed voltage signal or the combination thereof, the light intensity distribution can be changed, without requiring a switch per load and a control section for controlling the switches.

An embodiment of the light emitting device is defined by the element with the current-direction-dependency comprising a diode or a zener diode or a transistor. Diodes and zener diodes are relatively low-cost but show some voltage drop in a conducting state. In addition to the power losses associated with this, this voltage drop will also have influence on the voltage and hence current distribution in the light emitting device. This can be solved using transistors such as MOSFETs allowing this voltage drop in a conducting state to be reduced. Said transistors may require some local control in order to approximate the behavior of an ideal diode, but do not need to be controlled via a separate signal source and wiring extending beyond the light emitting device.

According to a second aspect, a system is provided comprising the light emitting device as defined above and further comprising the source. The source for example comprises an AC/DC converter or another converter or a switched mode power supply or another power supply.

An insight could be that a switch per load and a control section for controlling the switches can be avoided. A basic idea could be that main power is to be supplied to a group of load circuits directly from a source and that auxiliary power is to be supplied to the group of load circuits or a smaller group of load circuits from a capacitor different from the source.

The problem of providing an improved light emitting device has been solved. A further advantage could be that an increased number of lighting options have become possible in a simple way.

These and other aspects of the invention will be apparent from and elucidated with reference to the embodiments described hereinafter.

DETAILED DESCRIPTION OF EMBODIMENTS

Figure 1:
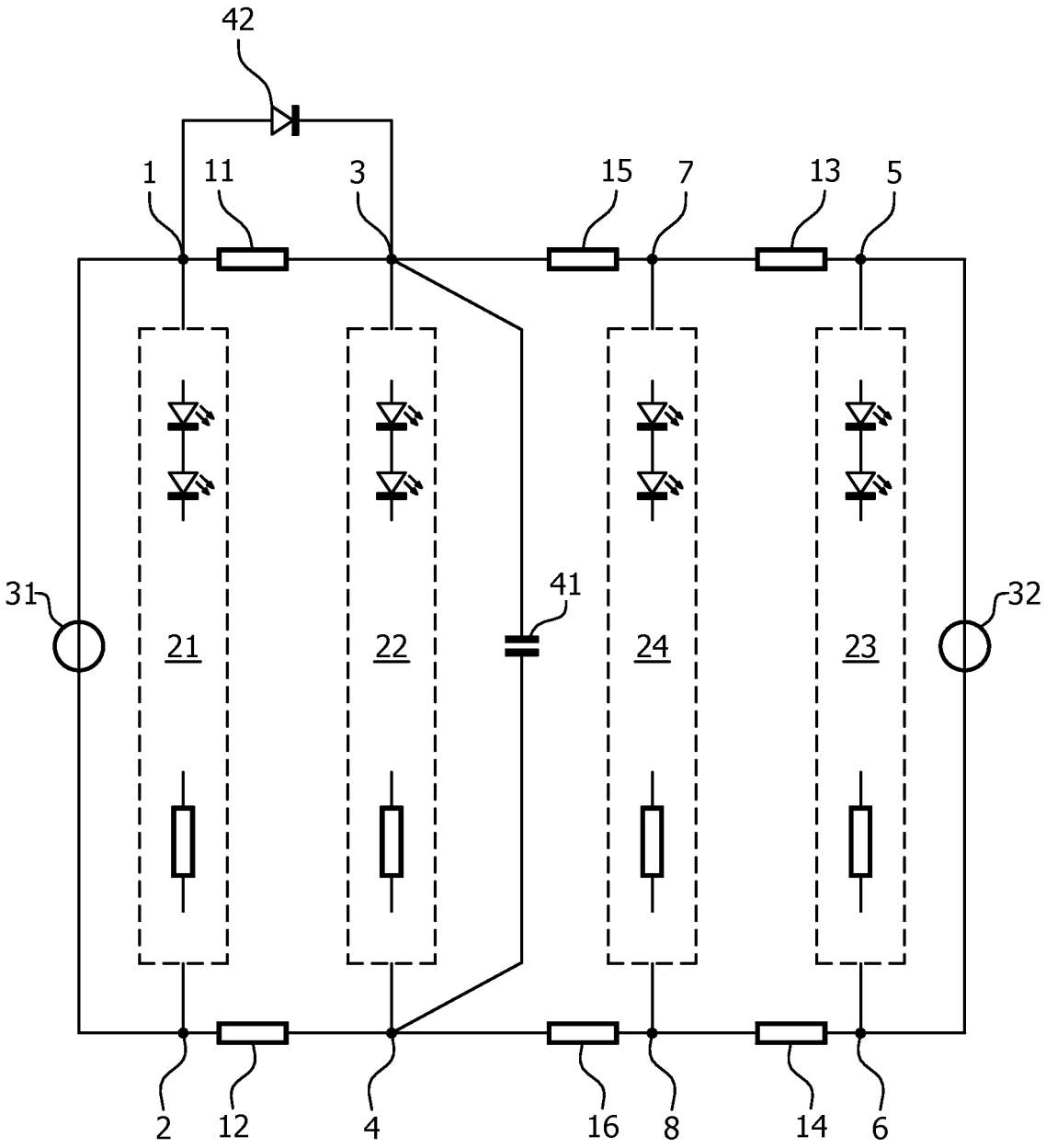
FIG. 1 shows a first embodiment of a system comprising a device.

In FIG. 1, a first embodiment of a system comprising a light emitting device is shown. The system comprises a first source 31 and a second source 32 and the device. The device comprises first and second terminals 1, 2 connected to a first load circuit 21 comprising at least one first light emitting diode and connected to the first source 31. The device further comprises third and fourth terminals 3, 4 connected to a second load circuit 22 comprising at least one second light emitting diode. The device further comprises a first connection 11 for interconnecting the first and third terminals 1,3, and a second connection 12 for interconnecting the second and fourth terminals 2, 4. At least one of the first and second connections 11, 12 is a power dissipating connection. The first load circuit 21 receives power from the first source 31, and the second load circuit 22 receives power via the first and second connections 11, 12 from the first source 31. The device further comprises a capacitor 41 coupled in parallel to the second load circuit 22 for storing energy received via an element 42 with a current-direction-dependency from the first source 31 and for providing power to the second load circuit 22 and for providing power to the first load circuit 21 via the first and second connections 11, 12. The element 42 with the current-direction-dependency may be a diode or a zener diode or a transistor etc.

Figure 2:
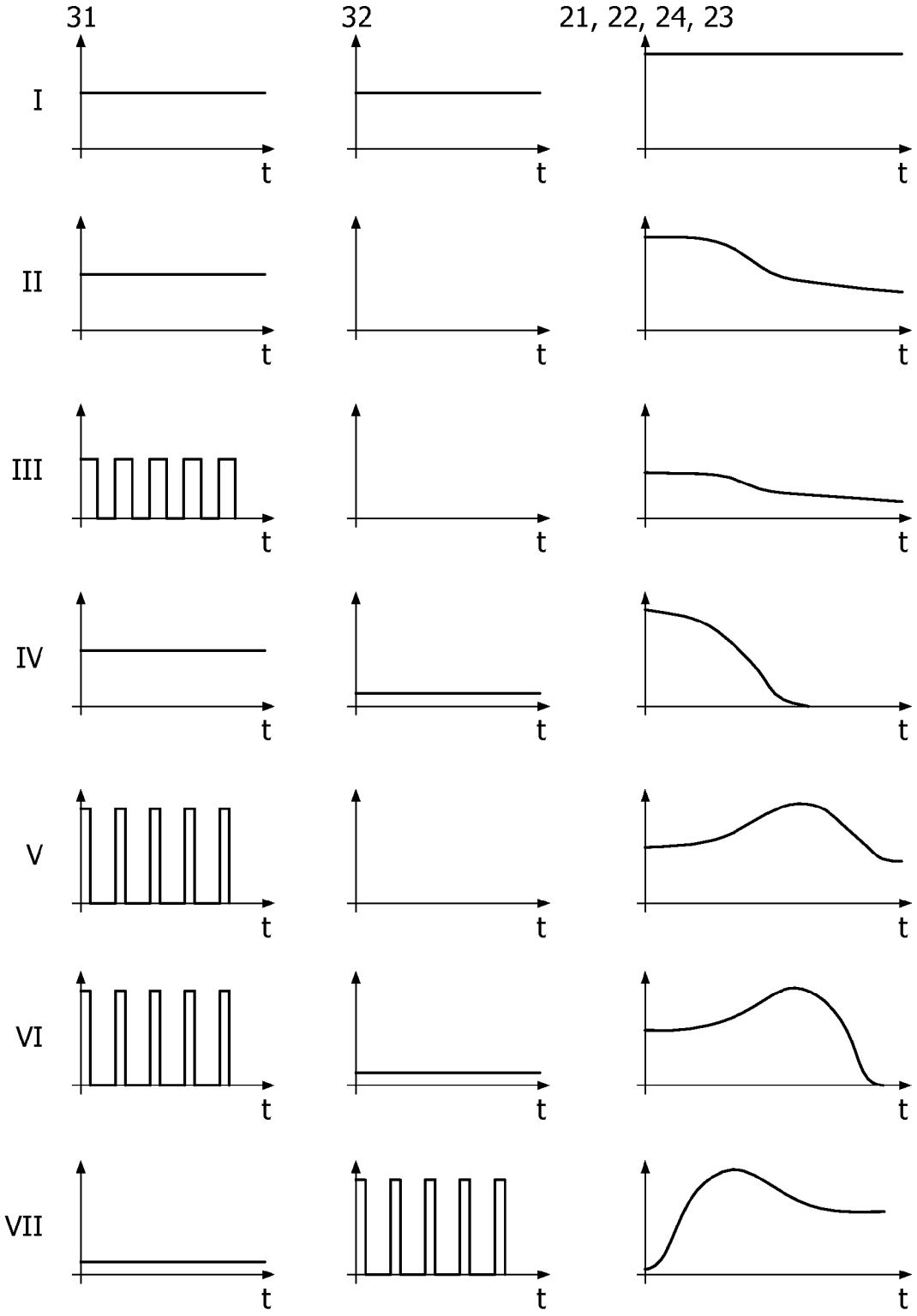
FIG. 2 shows source signals and light outputs.

The first source 31 may be adapted to supply the power for the first and second load circuits 21, 22 as well as the energy for the capacitor 41 in the form of a direct-current voltage signal or a pulsed voltage signal or a combination thereof, as further explained in view of FIG. 2.

The device may further comprise fifth and sixth terminals 5, 6 connected to a third load circuit 23 comprising at least one third light emitting diode and connected to the second source 32. The device may further comprise seventh and eighth terminals 7, 8 connected to a fourth load circuit 24 comprising at least one fourth light emitting diode. The device may further comprise a third connection 13 for interconnecting the fifth and seventh terminals 5, 7, and a fourth connection 14 for interconnecting the sixth and eighth terminals 6, 8. At least one of the third and fourth connections 13, 14 is a power dissipating connection. The third load circuit 23 receives power from the second source 32, and the fourth load circuit 24 receives power from the second source 32 via the third and fourth connections 13, 14.

The device may further comprise one or more further connections 15 for interconnecting the third and seventh terminals 3,7, and one or more further connections 16 for interconnecting the fourth and eighth terminals 4, 8. In this case, the first source 31 will feed the respective load circuits 21, 22, 24, 23 from left to right, and the second source 32 will feed the respective load circuits 23, 24, 22, 21 from right to left. Usually, a load circuit located closest to a source will receive more power from this source than a load circuit located farthest away from this source owing to the fact that at least some of the connections will be power dissipating connections.

Preferably, both first and second connections 11,12 may be power dissipating connections, wherein the first connection 11 may comprise a conductor with a resistance larger than zero, and the second connection 12 may comprise a resistor. Similarly, the third and fifth connections 13, 15 may comprise conductors, and the fourth and sixth connections 14, 16 may comprise resistors. Further preferably, the respective first and second load circuits 21, 22 may comprise respective first and second resistors connected serially to the respective first and second light emitting diodes. Similarly, the respective third and fourth load circuits 23, 24 may comprise respective third and fourth resistors connected serially to the respective third and fourth light emitting diodes. Further preferably, the first and second load circuits 21, 22 may have different operating voltages, and the third and fourth load circuits 23, 24 may have different operating voltages. This way, by selecting proper operating voltages of each load circuit and possibly of the element with the current-direction-dependency, and by selecting a proper value of each resistor, and by selecting a proper value or proper values of the direct-current or DC voltage signal or the pulsed voltage signal or the combination thereof, a power distribution can be realized that results in a uniform light intensity distribution. By adapting the value or values of the DC voltage signal or the pulsed voltage signal or the combination thereof, the light intensity distribution can be changed, without requiring a switch per load and a control section for controlling the switches. The second source 32 may be similar to the first source 31 or may be different from the first source 31. The second source 32 may be dispensed with and replaced by an "open" or by connections to the first source 31 such that the first source 31 feeds from left to right and from right to left.

Figure 3:
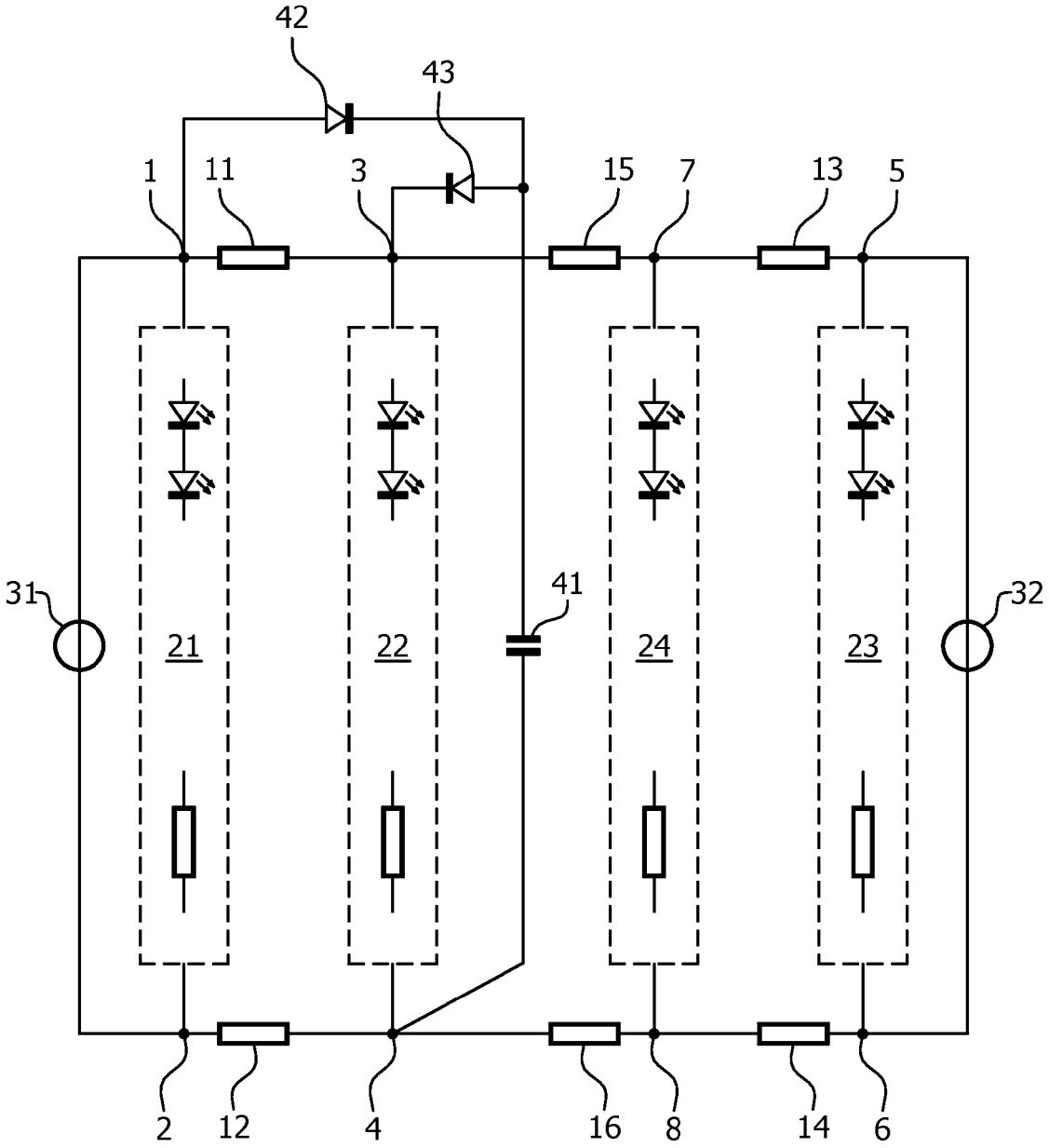
FIG. 3 shows a second embodiment of a system comprising a device.

In FIG. 2, in view of FIG. 3, source signals and light outputs are shown for the first source 31 as a function of time (left column) and for the second source 32 as a function of time (center column) and for the load circuits 21, 22, 24, 23 as a function of position (right column) for the cases I to VII (seven rows). Although, with a limited number of load circuits 21, 22, 24, 23 a stepped, localized light output would occur at specific positions of the light emitting device, in the right column an indication of the light output for a higher number of load circuits is depicted, resulting in a smooth graph.

Case I: Both first and second sources 31, 32 provide a DC voltage signal, all operating voltages and resistors have been chosen such that each load circuit 21, 22, 24, 23 provides the same light intensity.

Case II: The second source 32 is switched off and becomes an "open" with a relatively high resistance value, and the light intensities of the load circuits 21, 22, 24, 23, compared to case I, exhibit smaller values from left to right.

Case III: The first source 31 produces a pulsed voltage signal having an amplitude similar to the previous DC voltage signal, as a result of which the capacitor 41 still remains not involved, and the light intensities of the load circuits 21, 22, 24, 23, compared to case II, each exhibit a smaller value owing to the fact that the pulsed voltage signal has a duty cycle.

Case IV: The first source 31 provides a DC voltage signal having an amplitude similar to case I, but the second source 32 provides another DC signal at a relatively low amplitude (smaller than an operating voltage of the third load circuit 23) and consequently becomes a "short" with a relatively low resistance value, and the light intensities of the load circuits 21, 22, 24, 23, compared to case I, exhibit smaller values from left to right, but such that in this case the light intensity of the rightmost third load circuit 23 becomes zero owing to the fact that it is connected in parallel to the "short".

Case V: The first source 31 provides a DC voltage signal having a larger amplitude compared to cases I to IV, as a result of which the capacitor 41 becomes involved, but has a reduced duty cycle compared to case III, and the second source 32 is switched off and becomes an "open" with a relatively high resistance similar to case II. As a result, the light intensity of the leftmost first load circuit 21 will be about the same (higher current flowing through the first light emitting diode but for a fraction of the time). The light intensities of the centrally located second and fourth load circuits 22, 24 will increase owing to the fact that the capacitor 41 starts playing a role. The capacitor 41 will also deliver some smaller amounts of power to the leftmost first and rightmost third load circuits 21, 23, and the light intensity of the rightmost third load circuit 23 will be lower than that of the other three but larger than its value in case III.

Case VI: The second source 32 provides another DC signal at a relatively low amplitude (smaller than an operating voltage of the third load circuit 23) and consequently becomes a "short" with a relatively low resistance value, and the light intensity of the rightmost third load circuit 23, compared to case V, becomes zero owing to the fact that it is connected in parallel to the "short".

Case VII: The first and second sources 31, 32 exchange their signals, compared to case VI, and as a result the light intensities as present in case VI for the respective load circuits 21, 22, 24, 23 now become the light intensities for the respective load circuits 23, 24, 22, 21.

So, from case I to case II the light intensity is reduced on the right side, from case II to case III all light intensities are reduced, from case III to case IV the light intensity on the left side is increased and the light intensity on the right side becomes zero, from case IV to case V the light intensity in the center is increased and becomes larger than the intensity on the left side and the intensity on the right side is increased, from case V to case VI the light intensity on the right side becomes zero, and from case VI to case VII the light intensity on the left side becomes zero and the intensity on the right side is increased but stays smaller than the intensity in the center.

Clearly, the light can be "moved" across the area, while only using the extreme terminals at the outer corners of the area. Of course, various other light effects are possible, too, e.g. by having multiple capacitors connected to various segments and decoupled via diodes with different threshold voltages.

In FIG. 3, a second embodiment of a system comprising a device is shown, that only differs from the first embodiment in that an interconnection between the capacitor 41 and the element 42 with the current-direction-dependency is no longer directly coupled to the third terminal 3 but is coupled indirectly to this third terminal 3 via a further element 43 with a current-direction-dependency. This further element 43 with the current-direction-dependency prevents that the capacitor 41 is charged via a current path through the third and fourth terminals 3, 4 by a DC voltage signal or a pulsed voltage signal coming from the first source 31 but not passing through the element 42 with the current-direction-dependency.

Figure 4:
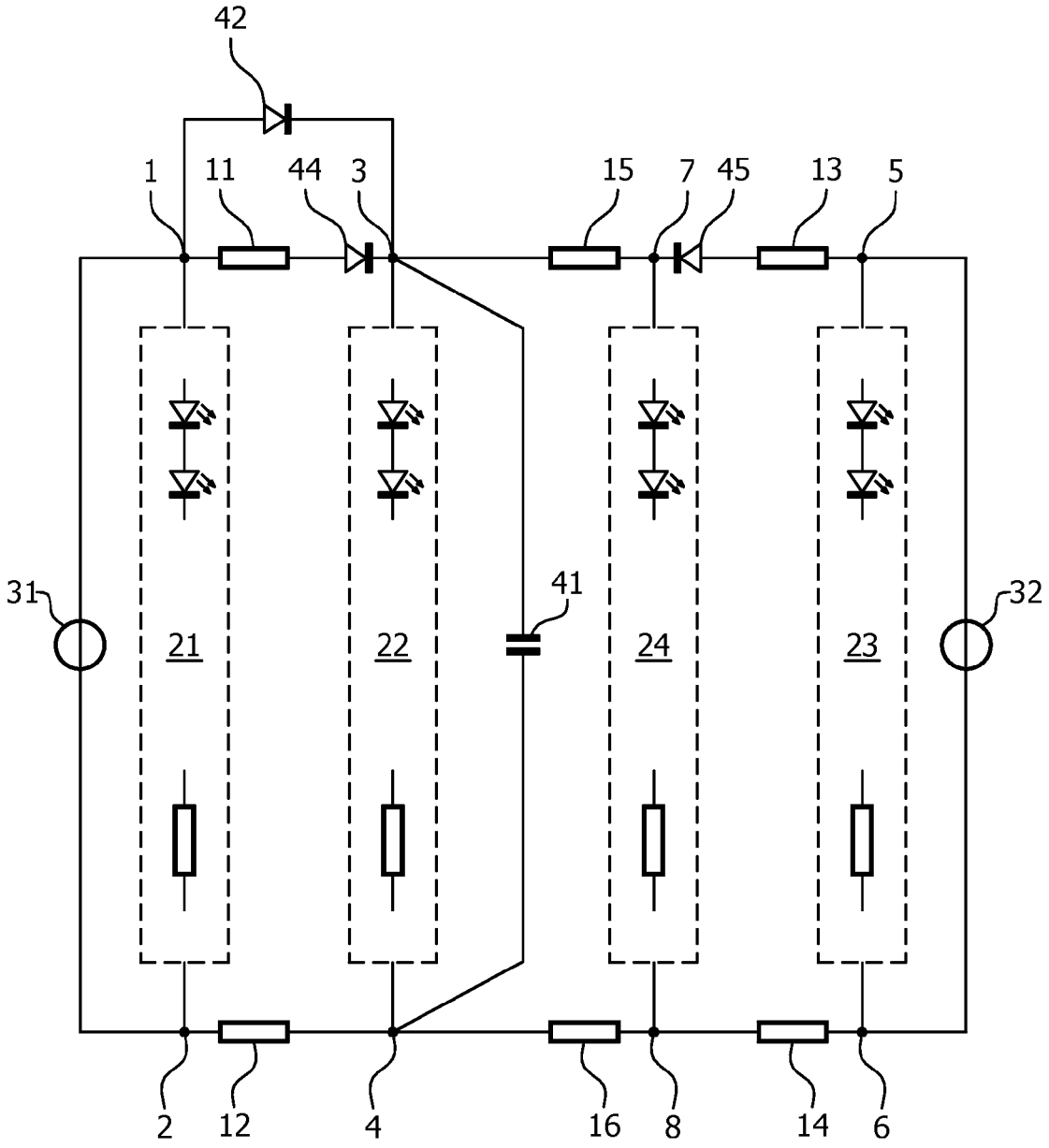
FIG. 4 shows a third embodiment of a system comprising a device.

In FIG. 4, a third embodiment of a system comprising a device is shown, that only differs from the first embodiment in that the first connection 11 connects the first and third terminals via a further element 44 with a current-direction-dependency that is adapted to prevent that the capacitor 41 provides a part of the power to the first load circuit 21 and in that the third connection 13 connects the fifth and seventh terminals via a yet further element 45 with a current-direction-dependency that is adapted to prevent that the capacitor 41 provides a part of the power to the third load circuit 23. Alternatively, the further element 44 with the current-direction-dependency may be added to the second connection 12, and the yet further element 45 with the current-direction-dependency may be added to the fourth connection 14.

The first (second etc.) load circuit 21 (22 etc.) comprises at least one first (second etc.) light emitting diode. When the first (second etc.) load circuit comprises more than one light emitting diode, the light emitting diodes may be interconnected in any serial and/or parallel connection. Preferably, a string of serially connected light emitting diodes is used per load circuit, and may be serially connected to a resistor as discussed before. Possibly, a capacitor may further be present, for example coupled in parallel to the string, to filter pulses of the pulsed voltage signal, to avoid peak currents and/or to avoid unwanted operation of the string in response to the pulses.

In FIGS. 1, 3 and 4, the first load circuit 21 is located closest to the first source 31, and the second load circuit 22 (that has the capacitor 41 coupled in parallel to it) is located farther away from the first source 31. However, although not shown here, it should not be excluded that the second load circuit 22 (that has the capacitor 41 coupled in parallel to it) is located closer to the first source 31 than the first load circuit 21. This of course corresponds with shifting the capacitor 41 from the second load circuit 22 to the first load circuit 21. However, in this case, further measures might need to be taken with respect to the element 42 with the current-direction-dependency and the amplitude levels of the voltage signals etc.

In FIGS. 1, 3 and 4, four load circuits 21, 22, 24, 23 are shown, but more load circuits are very well possible. For example, ten to twelve load circuits may be used, wherein the load circuits on the left and on the right may each have a string with eight to ten light emitting diodes and the load circuits in the center may each have a string with six to eight light emitting diodes to realize smaller operating voltages. The resistance values of the odd-numbered connections may be smaller than one Ohm, the resistance values of the even-numbered connections may be between one and one hundred Ohm, and the resistance values of the resistors in the load circuits may be larger than fifty Ohm. Within each load circuit, or per load circuit, different kinds of light emitting diodes may be used, such as different colors, different intensities, different sizes etc.

Although the embodiments have been described for direct-current or DC voltages, the invention may also be used in an alternating-current or AC environment, in which case further measures need to be taken, such as the introduction of rectifiers and/or anti-parallel light emitting diodes etc.

Summarizing, devices comprise first and second terminals 1, 2 connected to first load circuits 21 comprising first light emitting diodes, and third and fourth terminals 3, 4 connected to second load circuits 22 comprising second light emitting diodes, first connections 11 that interconnect the first and third terminals 1, 3, second connections 12 that interconnect the second and fourth terminals 2, 4, at least one of the first and second connections 11,12 being a power dissipating connection, at least one of the first and second load circuits 21, 22 being adapted to receive first power from a source 31 via the first and second connections 11, 12, and capacitors 41 coupled in parallel to the second load circuits 22 for storing energy received via elements 42 with current-direction-dependencies and for providing second power to at least the second load circuit 22.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A light emitting device comprising first and second terminals connected to a first load circuit comprising at least one first light emitting diode, third and fourth terminals connected to a second load circuit comprising at least one second light emitting diode, a first connection adapted to interconnect the first and third terminals, a second connection adapted to interconnect the second and fourth terminals, at least one of the first and second load circuits being adapted to receive first power from a source via the first and second connections, a capacitor coupled in parallel to the second load circuit and adapted to store the energy received via an element with a current-direction-dependency and to provide second power to at least the second load circuit, wherein both the first and the second connection is a power dissipating connection;

the first connection comprises a conductor with a resistance larger than zero; and the second connection comprises a resistor.

2. The light emitting device as defined in claim 1, the capacitor being coupled in parallel to the second load circuit via a further element with a current-direction-dependency that is adapted to prevent that the capacitor is charged via a current path through the third and fourth terminals.

3. The light emitting device as defined in claim 1, at least one of the first and second connections being adapted to connect respectively the first and third terminals and the second and fourth terminals via a further element with a current-direction-dependency that is adapted to prevent that the capacitor provides a part of the second power to the first load circuit.

4. The light emitting device as defined in claim 1, the source being adapted to supply the first power as well as the energy in the form of a direct-current voltage signal or a pulsed voltage signal or a combination thereof.

5. The light emitting device as defined in claim 4, the first load circuit comprising a further capacitor adapted to filter the pulsed voltage signal.

6. The light emitting device as defined in claim 1, the first and second terminals being adapted to be coupled to the source, the second load circuit being adapted to receive the first power from the source via the first and second connections.

7. The light emitting device as defined in claim 6, further comprising fifth and sixth terminals connected to a third load circuit comprising at least one third light emitting diode, the third load circuit being adapted to receive third power from a further source.

8. The light emitting device as defined in claim 7, further comprising seventh and eighth terminals connected to a fourth load circuit comprising at least one fourth light emitting diode, a third connection adapted to interconnect the fifth and seventh terminals, and a fourth connection adapted to interconnect the sixth and eighth terminals, at least one of the third and fourth connections being a power dissipating connection, and the fourth load circuit being adapted to receive fourth power from the further source via the third and fourth connections.

9. The light emitting device as defined in claim 8, the third and seventh terminals being adapted to be connected to each other via one or more further connections, and the fourth and eighth terminals being adapted to be connected to each other via one or more further connections.

10. The light emitting device as defined in claim 1, the first load circuit being adapted to receive the first power from the source via the first and second connections.

11. The light emitting device as defined in claim 1, the respective first and second load circuits comprising respective first and second resistors connected serially to the respective first and second light emitting diodes.

12. The light emitting device as defined in claim 1, the first and second load circuits having different operating voltages.

13. The light emitting device as defined in claim 1, the element with the current-direction-dependency comprising a diode or a zener diode or a transistor.

14. A system comprising the light emitting device as defined in claim 1 and further comprising the source.

* * * * *